US006648696B2

(12) United States Patent
Zemanik

(10) Patent No.: US 6,648,696 B2
(45) Date of Patent: Nov. 18, 2003

(54) PLUG-IN CONNECTION SYSTEM HAVING CONTACT PATHS FIXED IN AN INSULATION BODY

(75) Inventor: Zbynek Zemanik, Ostravice (CZ)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/194,246

(22) Filed: Jul. 15, 2002

(65) Prior Publication Data

US 2003/0022560 A1 Jan. 30, 2003

Related U.S. Application Data

(63) Continuation of application No. PCT/EP00/13133, filed on Dec. 21, 2000.

(30) Foreign Application Priority Data

Jan. 14, 2000 (EP) ..... 00100741

(51) Int. Cl.[7] ..... H01R 13/10; H01R 33/76; H01R 12/00

(52) U.S. Cl. ..... 439/682; 439/79; 439/684; 439/701

(58) Field of Search ..... 439/682, 684, 439/686, 688, 690, 691, 701, 79, 80, 676

(56) References Cited

U.S. PATENT DOCUMENTS 4,671,584 A * 6/1987 Barkus et al. ..... 439/78
5,961,355 A * 10/1999 Morlion et al. ..... 439/686
6,249,068 B1 6/2001 Knopp ..... 310/71

FOREIGN PATENT DOCUMENTS

| | | |
|---|---|---|
| DE | 2 203 513 A | 8/1973 |
| DE | 42 25 496 A1 | 2/1994 |
| EP | 0 538 495 B1 | 4/1993 |
| EP | 0 657 963 A1 | 6/1995 |
| EP | 0 724 313 A2 | 7/1996 |

* cited by examiner

*Primary Examiner*—Lynn Feild
*Assistant Examiner*—Michael C. Zarroli
(74) *Attorney, Agent, or Firm*—Sughrue Mion, PLLC

(57) ABSTRACT

A plug-in connection system, having contact paths (2; 3) that are inserted into lateral receiving pockets (1.2; 1.3) of an insulation body (1) and that are fixed with a positive fit in a final assembly position by sliding the contact paths in a longitudinal direction perpendicular to the insertion direction. Preferably, fixation elements (1.3; 1.4; 1.5; 1.6) on the insulation body prevent dislocation of each contact path (2; 3) in at least three directions. Specifically, bearing webs (1.3; 1.4) that respectively overlap each contact path prevent the contact path from moving in a direction opposite to the insertion direction. Limit stops (1.6) and a clamping web (1.5) that snaps behind the contact paths prevent displacement of the contact paths in the longitudinal direction and in the direction opposite the longitudinal direction once the contact paths reach the final assembly position.

18 Claims, 4 Drawing Sheets

PLUG-IN CONNECTION SYSTEM HAVING CONTACT PATHS FIXED IN AN INSULATION BODY

This is a Continuation of International Application PCT/EP00/13133, with an international filing date of Dec. 21, 2000, which was published under PCT Article 21(2) in German, and the disclosure of which is incorporated into this application by reference.

FIELD OF AND BACKGROUND OF THE INVENTION

The invention relates to a plug-in connection system with contact paths that are fixed in an insulation body. Such plug-in connection systems are required especially for actuators in motor vehicles between motor-internal power and control connections on the one hand and a motor-external electric power and control unit on the other hand. The power and control unit is preferably accommodated in an electronics enclosure which is separate from the housing of the motor and which can be assembled into one unit with the motor housing by plug-in contacting. The electric motor, generally provided with a downstream gear unit, is preferably embodied as a commutator motor that is supplied by the vehicle's DC distribution system.

Prior art publications DE 42 25 496 A1 and EP 0 538 495 B1, for instance, disclose actuators that include an electric motor with an axially flanged gear unit and with a preferably paraxial supply and control unit.

European Patent EP 0 538 495 B1, discloses an electronics enclosure holding a printed circuit board that is provided with the control and/or monitoring electronics for the motor. The electronics enclosure is parallel to the axis of the motor housing and is open at the end face thereof but is otherwise sealed. At its end face, the electronics enclosure can be overhung mounted or mechanically plugged into a corresponding housing flange opening of the gear unit and/or the motor housing and can thereby also be electronically contacted as well. When on the one hand the gear case or motor housing and on the other hand the electronics housing are mechanically interconnected, the printed circuit board equipped with its motor control and/or monitoring electronics is automatically connected by means of plug-in contacts to corresponding motor connectors on a brush holder plate of the commutator motor.

German Laid-Open Publication DE 22 03 513 A discloses a panel jack, in particular for printed circuit boards, with a contact fork spring which can be inserted into a receiving opening that extends in a plug-in contacting direction of an insulating body from the rear end face thereof, and which locks in its final assembly position.

OBJECTS OF THE INVENTION

An object of the present invention is to provide a plug-in connection system that permits the use of low-cost, in particular automated, manufacturing technology for mounting contact paths onto the insulating body of the plug-in connection system, whereby the contact paths are preferably configured as flat stampings. Another object of the invention is to ensure that the plug-in connection system reliably contacts the component to be contacted, which, is, for instance, an electric motor.

SUMMARY OF THE INVENTION

These and other objects are attained by a plug-in connection system, which, according to one formulation, includes:

an insulation body having laterally open guide pockets; and contact paths fixed in the insulation body such that the contact paths are inserted, perpendicularly to a contacting plug-in direction of the plug-in connection system, in a positive fit into the guide pockets and are brought into and fixed in a final assembly position by displacing the contact paths longitudinally along respective insertion planes of the contact paths.

According to another formulation, the invention is directed to an electrical connector plug that includes: at least one power contact track; a main insulation body having a first side configured to rest against a surface of a circuit board and having a second side, orthogonal to the first side, configured with a guide pocket that receives the power contact track; and a clasp, a limit stop and a resilient member all extending from the main insulation body. The power contact track is secured between the clasp and the main insulation body and is also secured between the limit stop and the resilient member in a final assembly position. The resilient member is deflected by the power contact track in a non-final assembly position and latches the power contact track in the final assembly position.

The plug-in connection system according to the invention makes it possible to provide the insulation body with the contact paths using an assembly technology suitable for automated production. In a first assembly step, the contact paths are laterally inserted into the guide pockets with a positive fit to secure them in directions perpendicular to the direction of insertion and to prevent dislocation in the direction opposite the direction of insertion. In a second assembly step they are longitudinally displaced in the insertion plane up to the final assembly position and are fixed in this position. This fixation is advantageously accomplished by means of a positive fit using laterally protruding bearing webs that are connected to the insulation body and that overlap the contact paths as they are longitudinally displaced, so as to prevent the contact paths from moving outward, opposite the direction of insertion. This fixation is supplemented with at least one laterally protruding clamping web, which is connected to the insulation body and which can initially be elastically deflected by the contact paths as they are longitudinally displaced. When the contact paths reach their final assembly position the clamping web snaps back behind corresponding clamping web structures of the contact paths to fix them in a positive fit against the direction of displacement. The contact paths are also fixed in the direction of displacement in their final assembly position by a limit stop on the insulation body.

BRIEF DESCRIPTION OF THE DRAWINGS

The invention and specific features and advantages thereof will now be described in greater detail with reference to schematic embodiments depicted by way of example in the drawing in which.

DETAILED DESCRIPTION OF THE PREFERRED EMBODIMENTS

Figure 1:
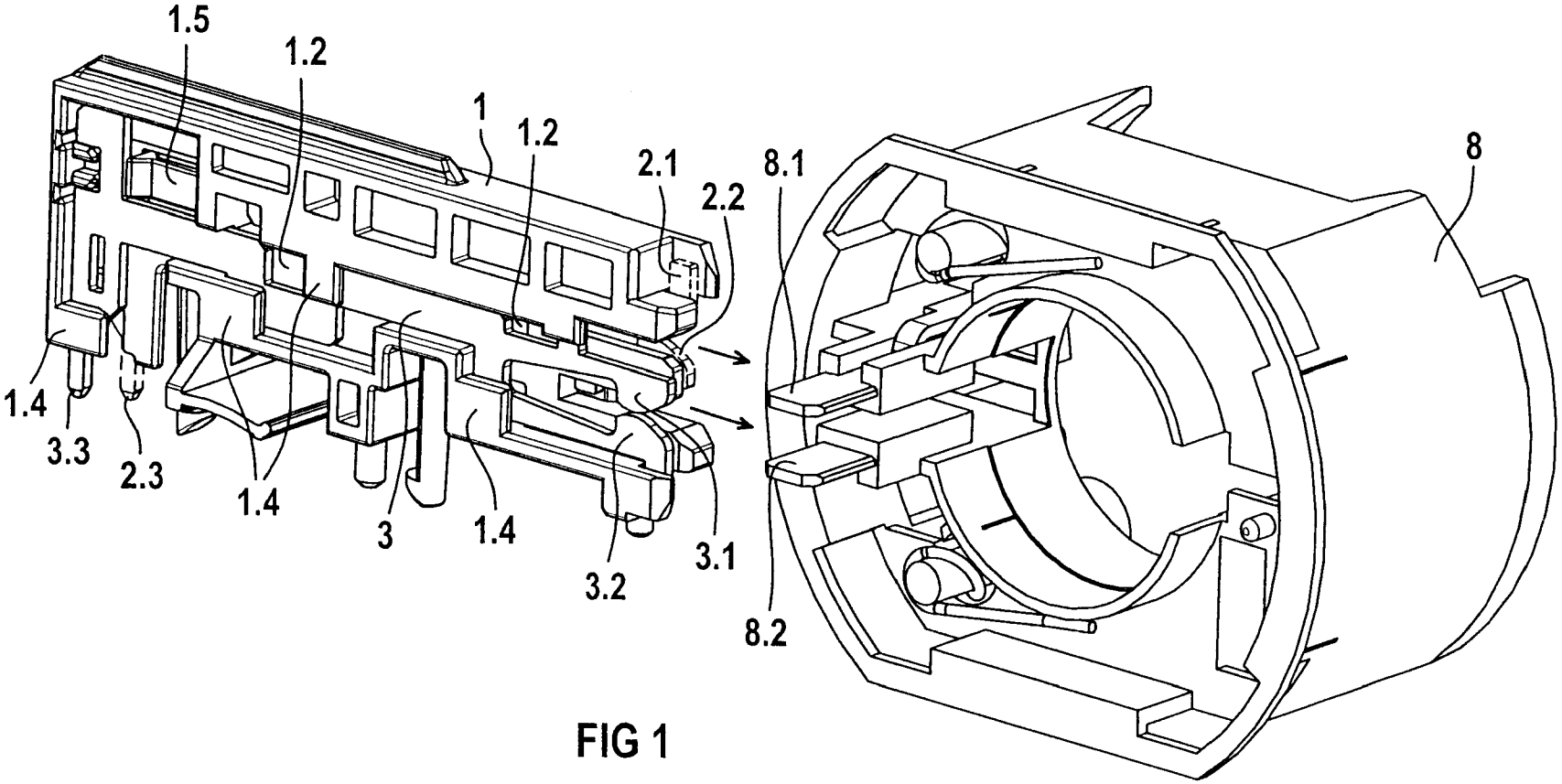
FIG. 1 is a perspective exploded view of a plug-in connection system prior to being assembled with a brush unit of a commutator motor.

FIG. 1 shows a plug-in connection system 1–3, which includes, essentially, an insulation body 1 and contact paths 2; 3 received therein, and which contacts with a brush unit 8 of a commutator motor (not depicted in further detail) by clipping it on in the direction of the double arrows. The contact paths 2; 3 embrace corresponding contact pins 8.1; 8.2 of the brush unit 8 with their contact tongues 2.1; 2.2 and 3.1; 3.2. The contact paths 2; 3, which are preferably configured as stamped flat contact paths, are connected by means of contact legs 2.3; 3.3 to a supply and control unit (not depicted) that is configured, for instance, on a printed circuit board. The supply and control unit is, e.g., a component of a motor-driven actuator for a motor-driven window winder or sunroof drive in a motor vehicle, such as those known from the prior art described above.

Figure 2:
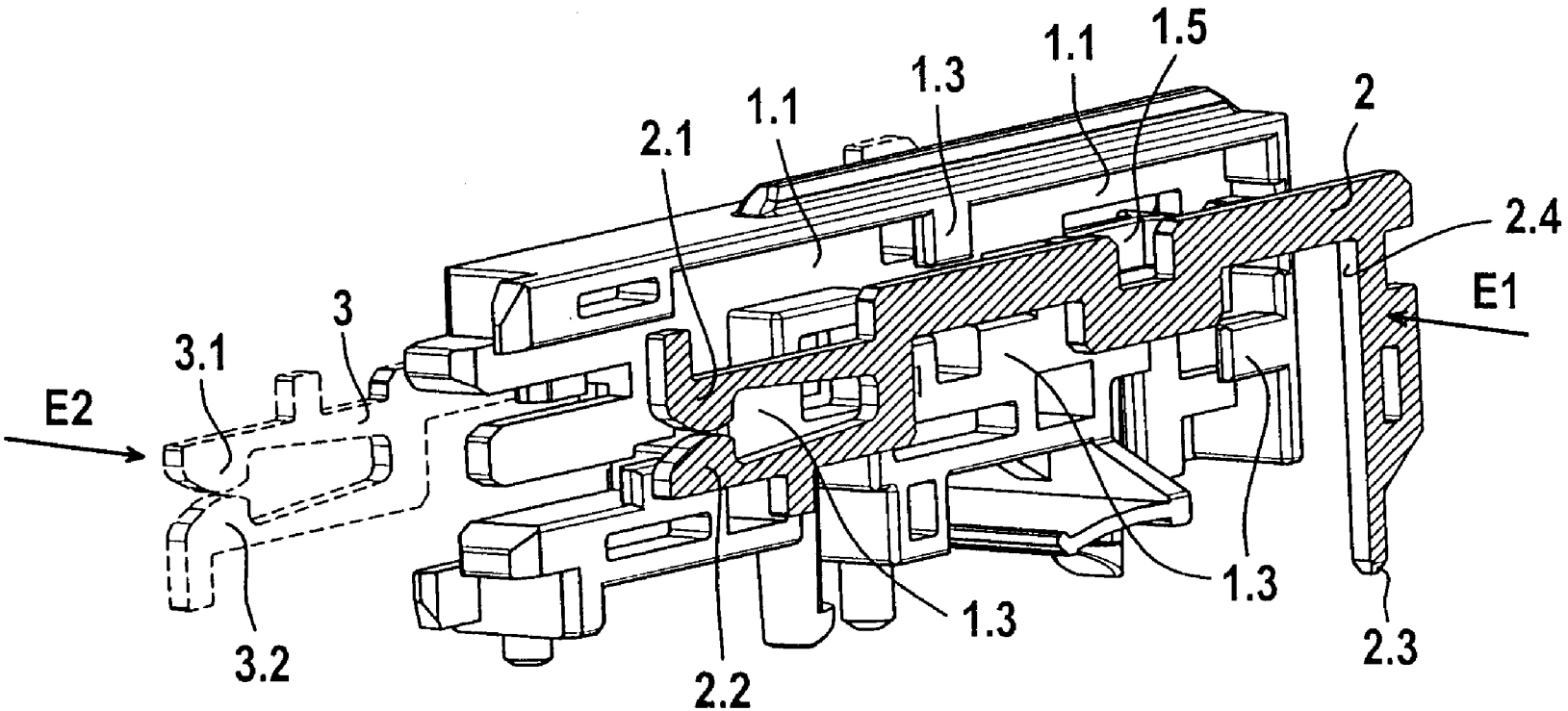
FIG. 2 is a perspective exploded view of the plug-in connection system according to FIG. 1 with laterally approaching contact paths, which are, however, not yet inserted into their guide pockets.

FIG. 2 shows an inventive plug-in connection system in an embodiment with a flat insulation body and having a first contact path plane on a forward side face, which is to be equipped with a first contact path 2, and having a second contact path plane on a rearward side face, which is to be equipped with a second contact path 3. The contact paths are placed onto the insulation body 1, respectively, in insertion direction E1 for the first contact path 2 and in insertion direction E2 for the second contact path 3 in a first assembly step.

Figure 3:
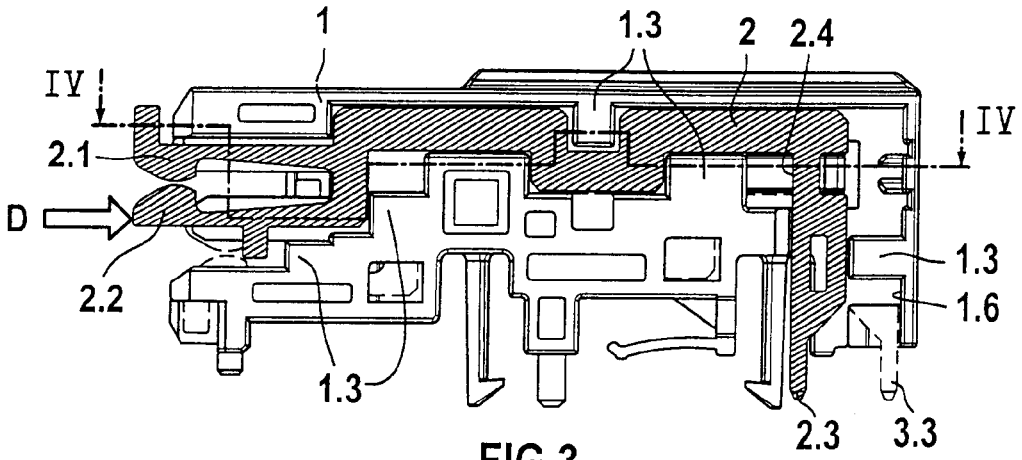
FIGS. 3, 4 show the plug-in connection system in a side view and a section along line IV—IV with contact paths that are laterally inserted into guide pockets of the insulation body, following a first assembly step.
Figure 4:
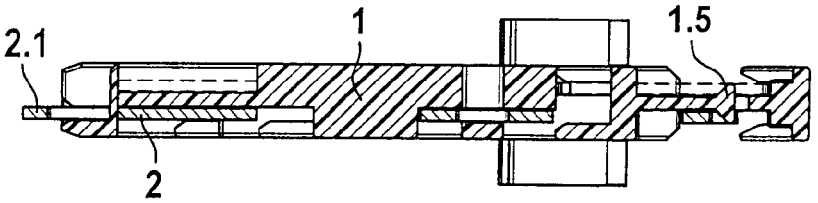
Figure 5:
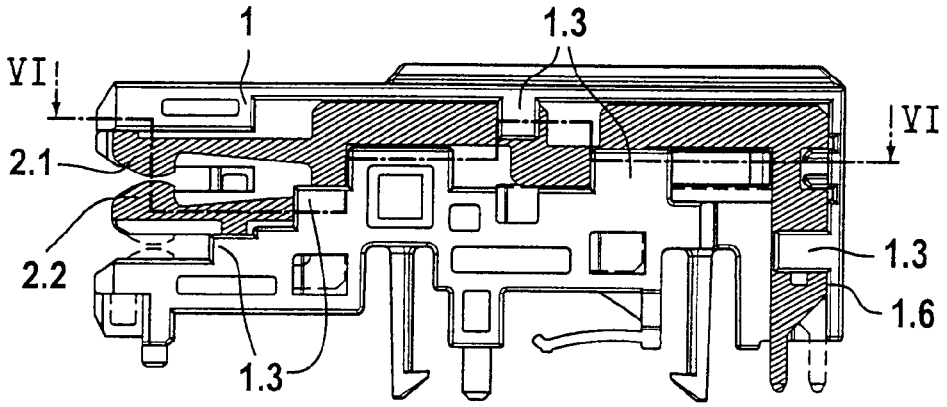
FIGS. 5, 6 show the plug-in connection system in a side view and a section along line VI—VI with contact paths longitudinally displaced and fixed in their final assembly position, following a second assembly step.
Figure 6:
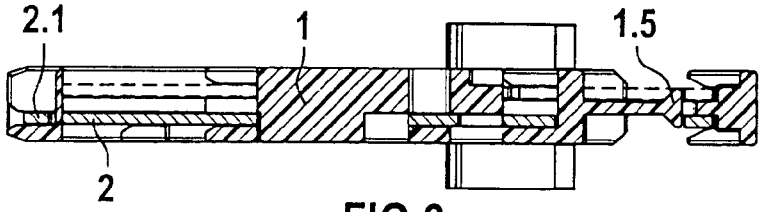
Figure 7:
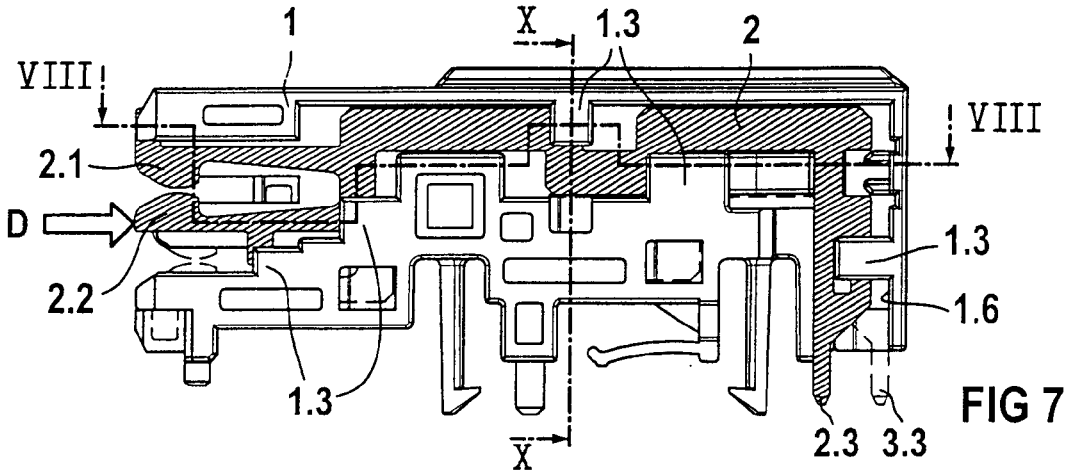
FIGS. 7, 8 show the plug-in connection system in a side view and a section along line VIII—VIII during an intermediate assembly step of the longitudinal displacement of the contact paths.
Figure 8:
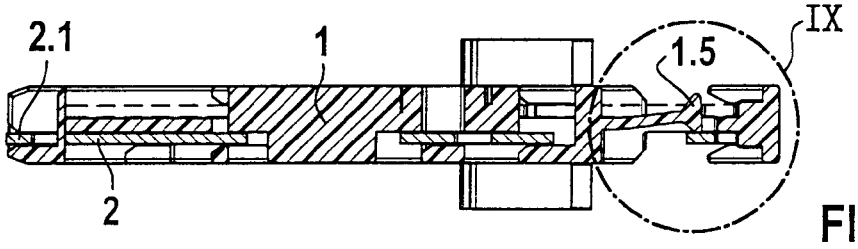

In this first assembly step, the contact paths 2; 3 are inserted into guide pockets 1.1; 1.2 of the insulation body 1, as shown in FIGS. 3, 4 (guide pockets 1.1 of the second contact path plane are visible in FIG. 2, while guide pockets 1.1 of the first contact path plane are partially visible in FIG. 1), such that they come to rest on the insulation body 1 against the direction of insertion (as described with reference to FIGS. 3–9 in regard to the first contact path). Thereafter, the contact paths 2; 3 are guided to their final assembly position at right angles to the direction of insertion, as shown in FIGS. 5, 6. FIGS. 7, 8 show an intermediate assembly step, which will be further described below.

The contact paths 2; 3 are advantageously inserted into insulation body 1 such that their free ends protrude from the insulation body 1 in the direction of longitudinal displacement and can be simply longitudinally displaced into their final assembly position by applying an external pressure D, as shown in FIG. 3. According to one embodiment of the invention, the contact paths 2; 3 are designed to be slightly flexible in the area of their contact tongues 2.1; 2.2; 3.1; 3.2 at the end face, in order to compensate tolerances and ensure reliable contacting with the contact pins 8.1; 8.2 of the brush holder 8, while in the remaining area they are designed to provide a positive fit in the guide pockets 1.1; 1.2 of the insulation body 1.

According to one embodiment of the invention, as contact paths 2, 3 are longitudinally displaced, they are overlapped by bearing webs 1.3; 1.4, which laterally protrude from and are connected with the insulation body 1. As a result, the contact paths are fixed in position in a positive fit when they reach their final assembly position.

Figure 9:
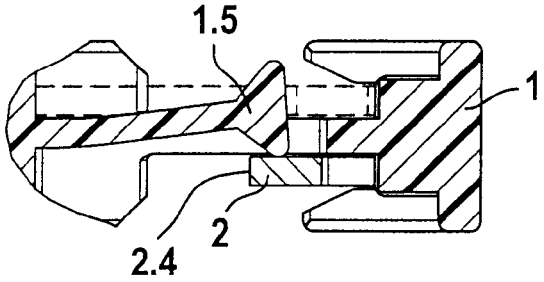
FIG. 9 is an enlarged detail from FIG. 8 of area IX.

When the final assembly position is reached, further longitudinal displacement in the direction of displacement is advantageously prevented by a limit stop 1.6 of the appropriately configured guide pockets 1.1; 1.2. According to one embodiment of the invention, which is illustrated in FIG. 9, a single clamping web 1.5 fixes the position of the contact paths 2; 3 against the direction of displacement after they have reached their final assembly position. This clamping web 1.5 is initially elastically deflected into the second contact path plane as the first contact path 2 is displaced longitudinally into its final assembly position. When the first contact path 2 reaches its final assembly position, it snaps behind an associated clamping web structure 2.4 of the first contact path 2, thereby locking the first contact path 2 into place. The final assembly position, in which dislocation of the contact path 2 is prevented, is shown in FIGS. 5 and 6. The bearing webs 1.3; 1.4 prevent dislocation in the direction opposite the insertion direction and are specific embodiments of a clasp. The clamping web 1.5 is a specific embodiment of a resilient member and prevents dislocation in the direction opposite the displacement direction.

Correspondingly, the clamping web 1.5 is elastically deflected into the first contact path plane as the second contact path 3 is subsequently longitudinally inserted. When the second contact path 3 reaches its final assembly position, the clamping web 1.5 snaps back into its rest position. In this position, it snaps not only against the corresponding clamping web structure 2.4 of the first contact path 2 but also against a respective clamping web structure of the second contact path 3 and thus secures the latter, too, in a positive fit against the direction of displacement. At least in the area of the elastically deflectable single clamping web 1.5, the first contact path and the second contact path are preferably mutually offset in elevation and configured in such a manner as to nonetheless ensure free deflection of the clamping web into each respective contact path plane even when the contact path for that contact path plane has already been inserted into its final assembly position.

Figure 10:
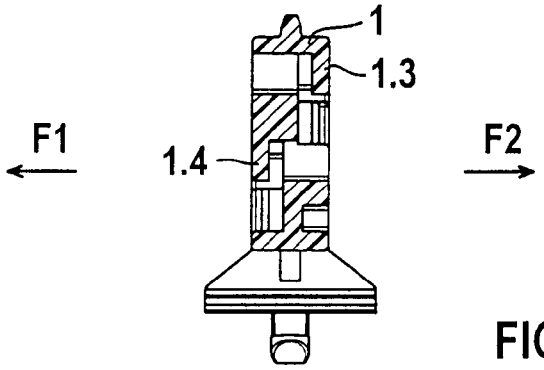
FIG. 10 is a section through the plug-in connection system according to FIG. 7 along line X—X.

Advantageously, the bearing webs 1.3; 1.4, like the clamping web 1.5 and the guide pockets 1.1; 1.2, are an integral component of the insulation body 1, which is preferably made of injection-molded plastic. In order to further simplify production, as may be seen from the sectional views, the aforementioned components are preferably distributed over the side faces of the insulation body in such a way that, when the insulation body 1 is injection-molded, these components are produced by parts of the injection mold that are pulled back solely perpendicularly to the contact path planes, i.e., in the direction F1 or F2 as shown in FIG. 10. This requires, in particular, that the components assigned to the one contact plane can each be accessed from the back side by associated injection molding parts, i.e., via the other contact path plane and through appropriate openings in the insulation body 1.

The above description of the preferred embodiments has been given by way of example. From the disclosure given, those skilled in the art will not only understand the present invention and its attendant advantages, but will also find apparent various changes and modifications to the structures and methods disclosed. It is sought, therefore, to cover all such changes and modifications as fall within the spirit and scope of the invention, as defined by the appended claims, and equivalents thereof.

What is claimed is:

1. Plug-in connection system, comprising:

an insulation body having laterally open guide pockets; and contact paths fixed in said insulation body;

wherein said insulation body is configured to receive said contact paths perpendicularly to a contacting plug-in direction of the plug-in connection system, and wherein the guide pockets are configured to receive said contact paths in a positive fit and to permit said contact paths to be brought into and fixed in a final assembly position through longitudinal displacement of said contact paths in parallel with the contacting plug-in direction and along respective insertion planes of said contact paths.

2. Plug-in connection system as claimed in claim 1, wherein two said contact paths are received, from two respective sides, into the laterally open guide pockets, in a first and a second of the contact path planes, of said insulation body.

3. Plug-in connection system as claimed in claim 2, wherein said contact paths are stamped flat contact paths.

4. Plug-in connection system as claimed in claim 1, further comprising fixation elements for each of said contact paths that provide a positive fit for and prevent dislocation of each said contact path respectively in each of first, second and third directions in the final assembly position, the first direction being opposite the insertion direction of said contact path, the second direction being the displacement direction of said contact path, and the third direction being opposite the displacement direction.

5. Plug-in connection system as claimed in claim 4, wherein said fixation elements comprise laterally protruding bearing webs connected to said insulation body, which overlap said contact paths as said contact paths are longitudinally displaced, and which provide the positive fit and prevent dislocation in the first direction.

6. Plug-in connection system as claimed in claim 4, wherein said fixation elements comprise at least one clamping web on said insulation body, which is configured to be elastically deflected by at least said contact path as said contact path is longitudinally displaced, and is configured to snap behind a clamping web structure of said contact path when said contact path reaches the final assembly position, and which provides the positive fit and prevents dislocation in the third direction.

7. Plug-in connection system as claimed in claim 6, wherein said insulation body has no more than one single clamping web, said clamping web being configured to be elastically deflected by two contact paths lying, respectively, in a first and a second of said contact path planes.

8. Plug-in connection system as claimed in claim 7, wherein said two contact paths are mutually offset in elevation at least in a vicinity of said clamping web and are configured to permit said clamping web to freely deflect laterally when both of said contact paths are fixed in the final assembly position.

9. Plug-in connection system as claimed in claim 1, wherein said insulation body is a substantially flat insulation body;

wherein the guide pockets are located on lateral surfaces of said insulation body; and wherein said contact paths comprise contact tongues on one end face of said insulation body that are configured to contact a component external to the plug-in connection system.

10. Plug-in connection system as claimed in claim 9, wherein the guide pockets each provide a loose seat having a non-positive fit of said contact tongues, providing a tolerance for said contact tongues and permitting said contact tongues to be deflected, in an area of the end-face of said insulation body; and wherein the guide pockets each provide a substantially fixed seat having a positive fit of the contact paths in a remaining area of said insulation body.

11. Plug-in connection system as claimed in claim 1, wherein said contact paths comprise contact path ends that protrude from said insulation body as said contact paths are longitudinally displaced; and wherein said contact path ends are configured to receive longitudinally directed pressure for displacing said contact paths into the final assembly position.

12. Plug-in connection system as claimed in claim 11, wherein said contact path ends are contact tongues configured to contact a component external to the plug-in connection system.

13. Plug-in connection system as claimed in claim 5, wherein the guide pockets and the bearing webs are integral with said insulation body.

14. Plug-in connection system as claimed in claim 13, wherein said insulation body is an injection-molded part.

15. Plug-in connection system as claimed in claim 6, wherein the guide pockets, the bearing webs and the clamping webs are integral with said insulation body.

16. Plug-in connection system as claimed in claim 15, wherein said insulation body is an injection-molded part.

17. An electrical connector plug, comprising:

at least one power contact track;

a main insulation body having a first side configured to rest against a surface of a circuit board and having a second side, orthogonal to the first side, configured with a guide pocket that receives said power contact track;

a clasp extending from said main insulation body, wherein said power contact track is secured between said clasp and said main insulation body in a final assembly position; and a limit stop and a resilient member extending from said main insulation body, wherein said power contact track is secured between said limit stop and said resilient member in the final assembly position;

wherein said resilient member is deflected by said power contact track in a non-final assembly position and latches said power contact track in the final assembly position.

18. The electrical connector plug according to claim 17, further comprising a second power contact track;

wherein said main insulation body has a third side, orthogonal to the first side, configured with a second guide pocket that receives said second power contact track; and wherein said resilient member additionally latches said second power contact track in the final assembly position.

* * * * *